US005547451A

United States Patent [19]

Drummond et al.

[11] Patent Number: 5,547,451

[45] Date of Patent: Aug. 20, 1996

[54] EASY-OPEN CONTAINER HAVING DIRECTIONALLY-ORIENTED LABEL TEAR

[75] Inventors: Michael T. Drummond, Florence; Calvin G. Hill, Hartsville; Richard M. Lowman, Jr., Hartsville; William C. Suski, Hartsville, all of S.C.; Rodney W. Roberts, Otisco, Ind.; James W. Lowry, Florence, S.C.

[73] Assignee: Sonoco Products Company, Hartsville, S.C.

[21] Appl. No.: 515,956

[22] Filed: Aug. 16, 1995

Related U.S. Application Data

[62] Division of Ser. No. 263,879, Jun. 22, 1994, Pat. No. 5,494,215.

[51] Int. Cl.[6] ..... B65D 85/00; B65D 3/26

[52] U.S. Cl. ..... 493/299; 493/297; 493/962

[58] Field of Search ..... 493/297, 298, 493/299, 300, 301, 302, 276, 279, 288, 273, 962

[56] References Cited

U.S. PATENT DOCUMENTS

| | | | |
|---|---|---|---|
| 2,793,127 | 5/1957 | Geist et al. | 229/202 |
| 3,162,347 | 12/1964 | Taylor | 229/4.5 |
| 3,215,328 | 11/1965 | White | 206/830 |
| 3,304,185 | 2/1967 | Fortney | 229/202 |
| 3,510,050 | 5/1970 | Culley et al. | 229/202 |
| 3,724,742 | 4/1973 | Henderson | 493/299 |
| 3,972,468 | 8/1976 | Reid | 229/202 |
| 4,073,950 | 2/1978 | Hansen et al. | 229/4.5 |
| 4,187,137 | 2/1980 | Beauchamp | 1565/195 |
| 4,343,427 | 8/1982 | Sansbury | 93/299 |
| 4,708,705 | 11/1987 | Aubry | 493/297 |
| 4,717,374 | 1/1988 | Elias | 493/299 |
| 4,978,406 | 12/1990 | Nakano | 493/297 |
| 5,076,440 | 12/1991 | Drummond | 229/202 |
| 5,232,429 | 8/1993 | Cizek | 493/299 |
| 5,251,809 | 10/1993 | Drummond et al. | 229/202 |
| 5,318,499 | 6/1994 | Rice | 493/299 |
| 5,460,721 | 10/1995 | Goodwin | 493/299 |

*Primary Examiner*—Jack W. Lavinder
*Assistant Examiner*—Christopher W. Day
*Attorney, Agent, or Firm*—Bell, Seltzer, Park & Gibson, P.A.

[57] ABSTRACT

An easy-open container has a spirally-wound paperboard bodywall layer, interior barrier liner layer and outer label layer forming an easy-open seam extending spirally between the ends of the container. A feature is provided for directionally-orienting tearing of the label layer to remove either the entire label layer or just that portion of the label layer which is in bridging relationship to the easy-open spiral seam to allow opening of the container along the spiral seam. The directionally-orienting tear feature is preferably provided by a reinforcing and tear strip having directionally-orienting tear incorporated therein and which is positioned under the outer longitudinal edge portion of the label layer and over the easy-open spiral seam along with desired positioning of low strength and high strength bonding between the label layer, reinforcing and tear strip and bodywall layer to ensure tearing of the label layer in the proper direction and removal of a desired portion of the label layer when the container is opened. The directionally-oriented tear feature may also include a directionally-orienting tear incorporated in the label layer itself to orient tear in the desired direction.

6 Claims, 4 Drawing Sheets

EASY-OPEN CONTAINER HAVING DIRECTIONALLY-ORIENTED LABEL TEAR

This application is a divisional of application Ser. No. 08/263,879, filed on Jun. 22, 1994, now U.S. Pat. No. 5,494,215.

FIELD OF THE INVENTION

This invention relates to an easy-open container for packaging various products, particularly products under pressure such as biscuit and bread dough and the like. More specifically, this invention relates to an easy-open container having a spirally-wound bodywall layer forming an easy-open seam extending spirally between the ends of the container, an interior barrier liner layer, and an outer label layer, and being provided with means for directionally-orienting tearing of the label layer to remove at least that portion of the label layer which is in bridging relation to the easy-open spiral seam in the bodywall layer to allow opening of the container along such spiral seam.

BACKGROUND OF THE INVENTION

Easy-open composite containers for packaging various products, particularly products under pressure such as refrigerated dough products and the like, constitute a significant commercial consumer product. Typically, these containers are formed of a spirally-wound paperboard or board stock bodywall layer and an interior liner layer for preventing leaking of the contents from the container. The spirally-wound bodywall layer usually includes a butt joint formed by adjacent edges of the bodywall layer and which forms a spiral seam extending from one end of the container to the other end. The exterior label layer surrounds the bodywall layer and covers or bridges the spiral seam to reinforce such seam and prevent premature opening along the spiral seam.

Commercially significant containers of this type are disclosed in commonly assigned U.S. Pat. No. 3,981,433 which is directed to a one-step easy-open container including an inner liner layer, a bodywall layer and an outer label layer, all of which are spirally-wound to form a spiral easy-open seam in the bodywall layer. In this type of container, when the outer label layer is either totally removed or that portion bridging the spiral butt joint of the bodywall layer is torn away from the spiral seam, the pressurized dough products expands outwardly and causes the spiral seam of the bodywall layer to open. This allows access to the dough and the interior of the container through the spiral easy-open seam in the container.

The outer label layer surrounding the spiral seam in containers of this type is an important structural component of the container because the outer label layer bridges the spiral seam and maintains it in closed position. Accordingly, in order to easy-open the container, that portion of the label layer which bridges the easy-open spiral seam of the bodywall layer must be stripped away to expose the spiral seam for easy-opening. Alternatively, the label layer may be totally peeled away from and removed from the bodywall layer of the container. This is desirable if a coupon or other advertising material is positioned under the label layer for removal by the purchaser of the container when opening of the container.

Various mechanisms have been provided to aid in such easy-opening including provision of a tear tab for starting the peeling or removal of the label layer so that the label layer may be torn toward a "collar cut" extending around the periphery of the label layer near one end of the container for completely removing the label layer from the bodywall layer during easy-opening. Also, tear strips have been provided between the label layer and the bodywall layer in bridging relation to the easy-open spiral seam of the bodywall layer to act as a tearing medium for tearing away that portion of the label layer which bridges the easy-open spiral seam of the bodywall layer. However, with both procedures for removing the label layer from the spiral easy-open seam of the bodywall layer, tearing of the label layer in a desired direction has created problems and often such tearing does not accomplish the desired purpose of either removing the entire label layer or just a bridging portion of the label layer from the spiral seam of the bodywall layer for easy-opening of the container. Tearing is also affected by the direction of pulling or tear pressure applied by the user which is sometimes dictated by being right-handed or left-handed or by having the container in an upright position or in an upside-down position.

OBJECT AND SUMMARY OF THE INVENTION

It is the object of this invention to provide an easy-open container for packaging various products, particularly products under pressure, and which includes therein means for directionally-orienting tearing of the label layer to remove at least that portion of the label layer in bridging relation to the easy-open spiral seam of the bodywall layer of the container to allow opening of the container along such spiral seam.

It has been found by this invention that the above object may be accomplished by providing an easy-open container particularly adapted for packaging products under pressure and which includes generally the following components and features.

A paperboard bodywall layer in strip form is spirally-wound and defines a substantially cylindrical container having opposed ends. The bodywall layer has longitudinal edges lying adjacent each other, preferably in abutting relationship, to define an easy-open spiral seam, preferably having a butt joint, extending between the opposed ends of the container. A flexible barrier liner layer in strip form is spirally-wound inside the bodywall layer in superimposed position therewith. A flexible label layer in strip form is spirally wound outside the bodywall layer in superimposed position therewith and has longitudinal edge portions overlapped with each other. The label layer is positioned in bridging relation to the easy-open spiral seam. A tab cut extends through the upper of the label layer edge portions and inwardly from the edge thereof to define a tear tab to be used in easy-opening of the container.

Means are provided for directionally-orienting tearing of the label layer to remove at least that portion of the label layer in bridging relation to the easy-open spiral seam to allow opening of the container along the spiral seam. Such directionally-orienting tear means may include means incorporated directly in the label layer and extending generally transversely of the label layer strip in generally a cross-machine direction along with a desired type of bonding of the label layer to the bodywall layer of the container. Alternatively, the directionally-orienting tear means may include a reinforcing and tear strip positioned on the inside of the upper of the overlapped label layer edge portions and in bridging relation to the easy-open spiral seam and having a directionally-orienting tear incorporated directly therein in a transverse or cross-machine direction along with high strength bonding means positioned between the reinforcing and tear strip and the upper label layer edge portion so that the label layer will tear with the tear strip for easy-opening of the container and other desired types of bonding between the label layer and the bodywall layer of the container.

If it is desired to remove the entire label layer during easy-opening of the container, the directionally-orienting tear means includes a low strength bonding means positioned between the label layer and the bodywall layer so that the label layer will peel and separate from the bodywall layer during removal of the label layer and/or reinforcing and tear strip from the easy-open spiral seam for opening of the container.

If it is desired to remove only that portion of the label layer which bridges the easy-open spiral seam of the bodywall layer, the directionally-orienting tear means includes a high strength bonding means positioned between the label layer and the bodywall layer so that the label layer will remain bonded to the bodywall layer and tear from the reinforcing and tear strip and the label layer edge portion bonded thereto during removal from the easy-open spiral seam.

Thus, an easy-open container is formed which has means for directionally-orienting tearing of the label layer to remove either the entire label layer from the container or at least that portion of the label layer which bridges the easy-open spiral seam to allow opening of the container along the spiral seam. The directionally-orienting tear feature will ensure that tearing of the label layer and/or the reinforcing and tear strip will occur as desired for accomplishing easy-opening of the container.

BRIEF DESCRIPTION OF THE DRAWINGS

In the drawings which form a part of the original disclosure of the invention.

DETAILED DESCRIPTION OF PREFERRED EMBODIMENTS

In the following detailed description, various preferred embodiments of the invention are described. It will be understood, however, that the invention is not to be limited to its preferred embodiments and although specific terms are employed in describing the preferred embodiments, these are for purposes of illustration only and not for purposes of limitation. It will thus be apparent that the invention includes various alternatives, modifications and equivalents within its spirit and scope as will be apparent to the skilled artisan.

Figure 1:
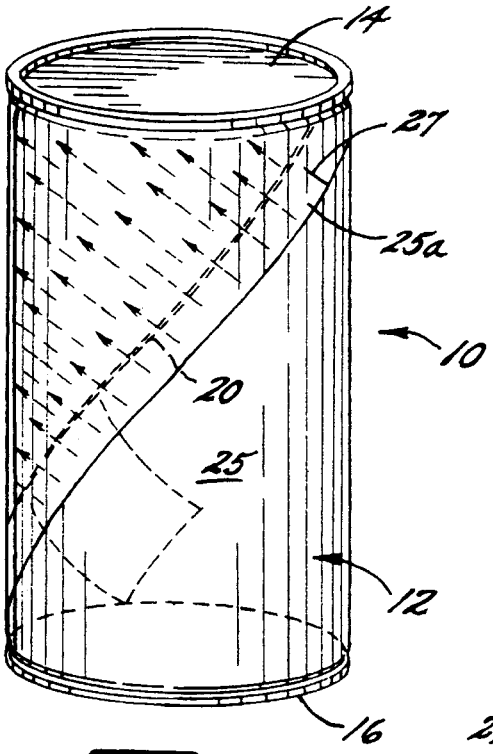
FIG. 1 is a perspective view of an easy-open container provided according to a preferred embodiment of this invention.
Figure 8:
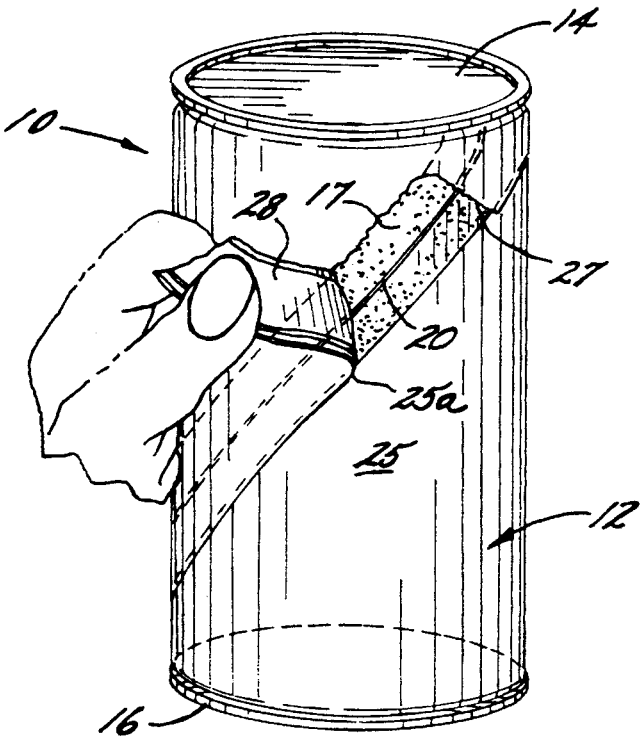
FIG. 8 is a perspective view of an easy-open container provided according to another preferred embodiment of this invention.
Figure 9:
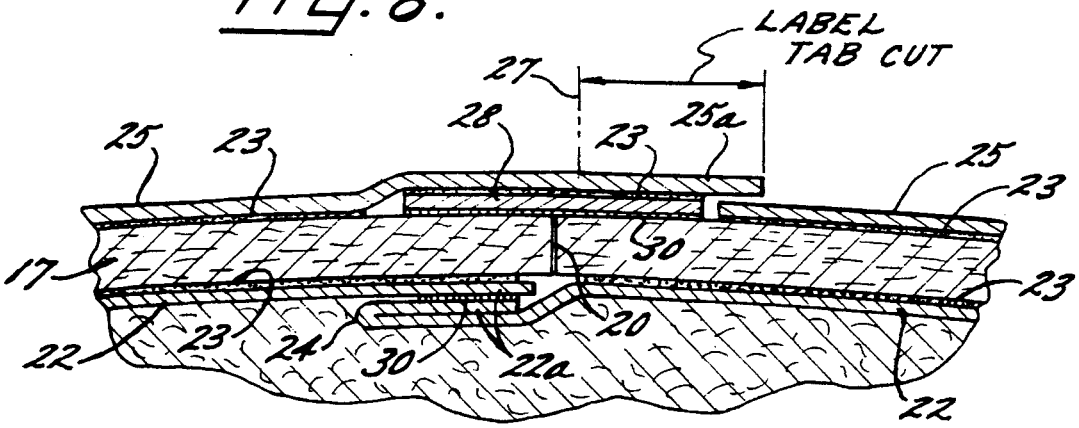
FIG. 9 is a greatly enlarged fragmentary sectional view taken generally along the line 9—9 of FIG. 8 and illustrating the construction of the easy-open seam of the container.
Figure 10:
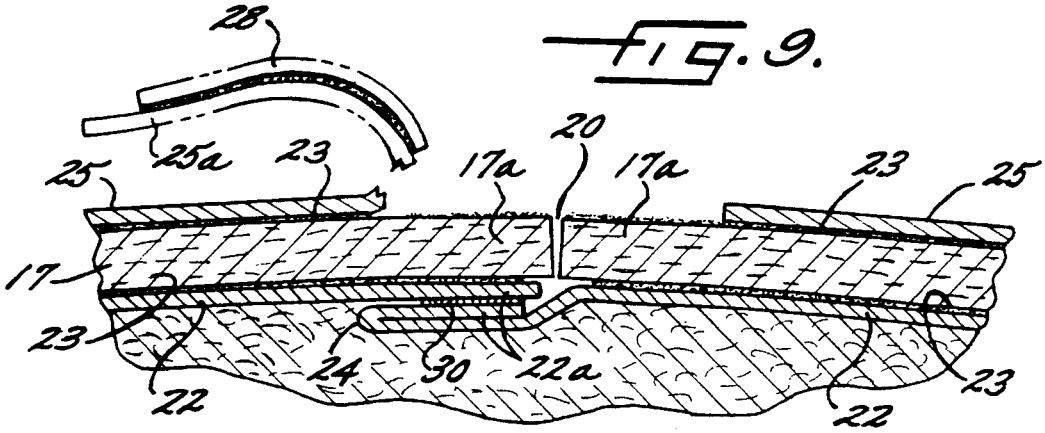
FIG. 10 is a cross-sectional view, like FIG. 9, illustrating the manner in which the container is easy-opened by tearing of the tear strip and the portion of the label layer bonded thereto from bridging relation with the spiral seam of the bodywall of the container.
Figure 11:
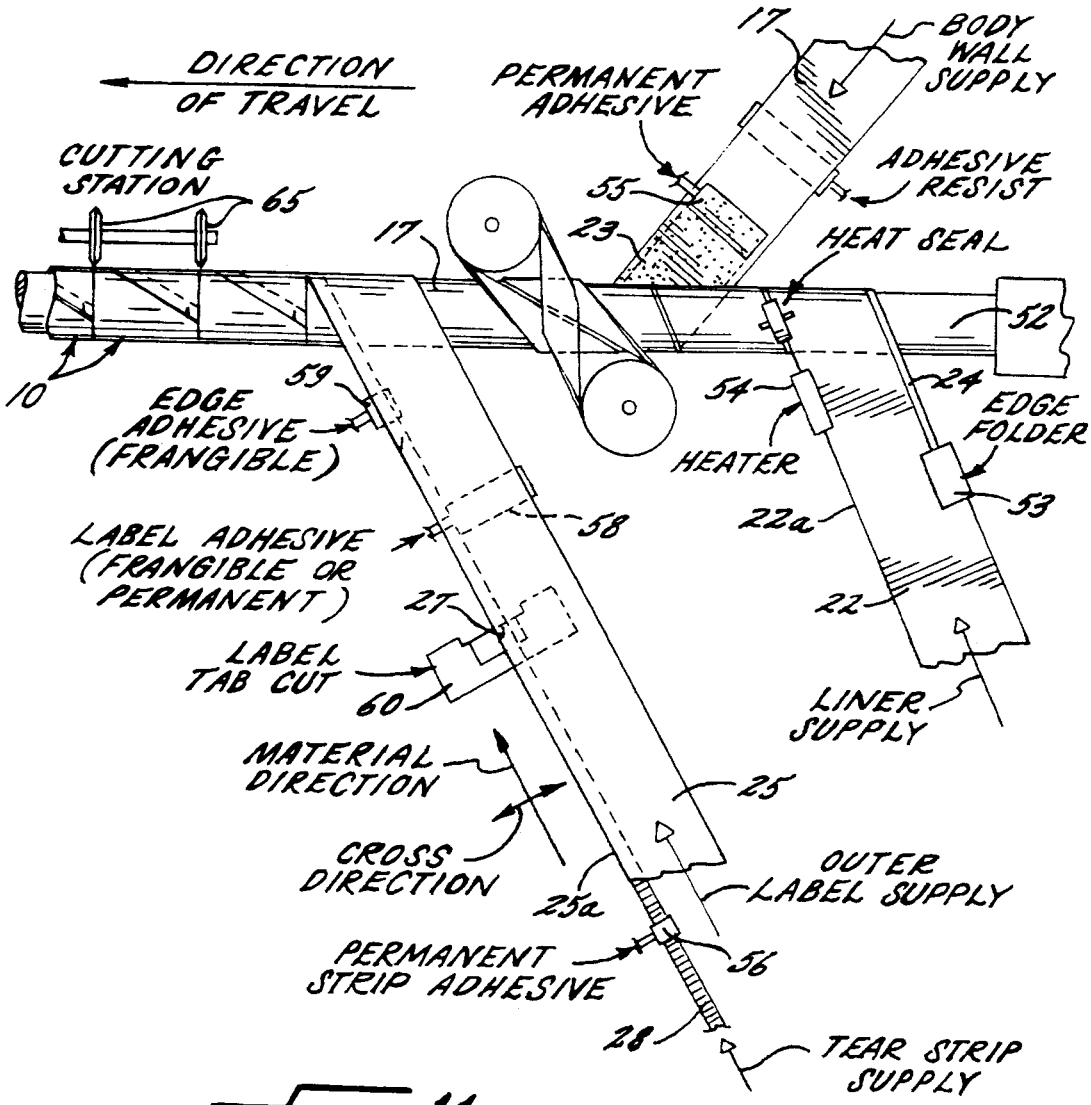
FIG. 11 is a diagrammatic view illustrating a preferred method and apparatus for producing the easy-open container of this invention.

Referring first to FIGS. 2–7, a preferred embodiment of an easy-open container be constructed in accordance with the present invention is illustrated therein. FIG. 1 illustrates a modification to the embodiment of an easy-open container be illustrated in FIGS. 2–7 and will be described thereafter. FIGS. 8–10 illustrate yet another preferred embodiment of a container be and will be described in detail below. FIG. 11 diagrammatically illustrates a preferred method and apparatus for forming a container be in accordance with this invention and will be described below.

The container be, of the embodiment illustrated in FIGS. 2–7, includes a generally cylindrical body portion 12, a top end closure 14 and a bottom end closure 16. The container further includes a spirally-wound paperboard bodywall layer 17 in strip form which forms the basic shape of the cylindrical body portion 12 of the container be. The bodywall layer 17 has longitudinal edges 17*a* lying adjacent each other, preferably in abutting relation, and defining an easy-open spiral seam 20, preferably in the form of a butt joint, extending between the opposed ends of the body 12 and between the end closures 14 and 16 of the container This bodywall layer 17 may be advantageously composed of conventional spiral-winding paperboard or board stock having a thickness of between 0.10 and about 0.35 inch, preferably between about 0.15 and 0.30 inch, for example 0.021 inch. Board stock conventionally used in the manufacture of spirally-wound containers is commercially available from various manufacturers including Sonoco Products Company, Republic Paperboard Corporation and Middletown Board Corporation. In order to function advantageously as the spirally-wound bodywall layer, the board stock typically is composed of kraft or recycled paper and can typically range from e.g. 50 to 100 lbs./ream. In some instances the board stock can include a weak exterior layer, e.g. a 0.003 inch exterior news.

The easy-open container 10 further includes a flexible barrier liner layer 22 in strip form spirally-wound inside the bodywall layer 17 in superimposed position therewith and has overlapping longitudinal edge portions 22*a* in bridging relation to the spiral seam. This liner layer 22 may advantageously be a barrier type, flexible sheet material, such as a polymer/foil, a kraft/foil/polymer, a polymer/polymer, or a kraft/foil laminate. A high strength bonding means 23, preferably in the form of a permanent adhesive, may be positioned between the liner layer and the bodywall layer 17. An expandable fold or pleat 24 may be provided in the lower of the overlapping liner layer edge portions 22*a* and in bridging relation to the butt joint of the spiral seam 20. The overlapping liner layer edge portions 22*a* may be bonded by a low strength bonding means 30, such as a heat seal. The liner layer 22 prevents the escape of liquids, oils and, preferably, gases into and out of the container bodywall layer 17 from the interior of the container 10 and expands through the easy-open spiral seam 20 during opening of the container be, as will be described in more detail below.

The container 10 further includes a flexible label layer 25 in strip form spirally-wound outside the bodywall layer 17 in superimposed position therewith and having longitudinal edge portions 25*a* overlapped with each other. The label layer 25 is positioned in bridging relation to the easy-open spiral seam 20 and in the embodiment of FIGS. 2–7, the overlapped label layer edge portions 25*a* are positioned in bridging relation to the easy-open spiral seam 20. The label layer 25 is conventionally constructed from suitable materials, such as kraft paper, a polymer/foil laminate, a kraft paper/foil laminate, or the like.

The easy-open container 10 further includes a tab cut 27 extending through the upper overlapped label layer edge portion 25*a* and inwardly from the outer edge thereof to define a tear tab which may be easily lifted open and pulled by the user to initiate easy-opening of the container be in a manner to be described below.

In the broadest aspect of this invention, means are provided for directionally-orienting tearing of the label layer 25 to ensure that the tearing of label layer 25 proceeds in the proper direction for removal of the desired portion thereof during easy-opening of the container be. This directionally-orienting tear means may take different forms and include different components of the container be and will be described with respect to each preferred embodiment of the container 10.

Figure 6:
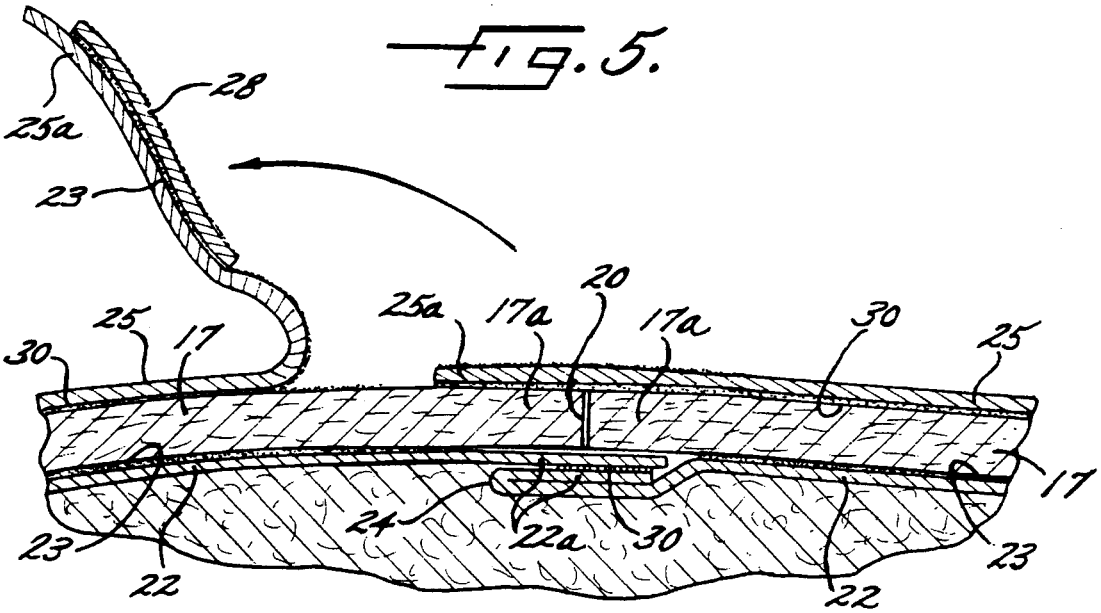
FIGS. 6 and 7 are cross-sectional views, like FIG. 5, illustrating the manner in which the container is easy-opened by removal of the entire label layer from the bodywall layer of the container and exposing the spiral seam.
Figure 7:
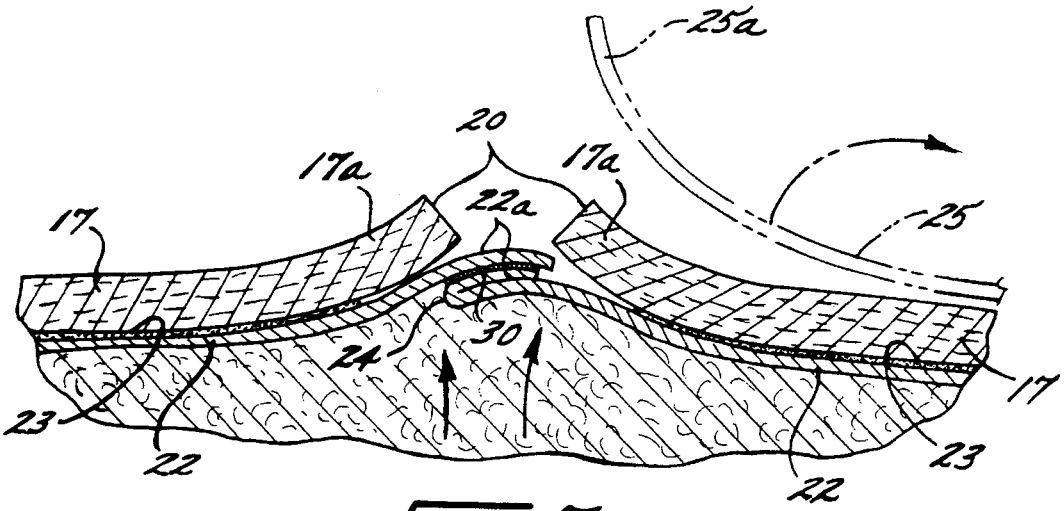

In the embodiment of easy-open container be illustrated in FIGS. 2–7, the directionally-orienting tear means includes the following. A reinforcing and tear strip 28 is positioned between the overlapped label layer edge portions 25*a* and in bridging relation to the easy-open spiral seam 20 for reinforcement thereof. A high strength bonding means 23, preferably in the form of a permanent adhesive, is positioned between the reinforcing and tear strip 28 and the upper label layer edge portion 25*a* so that the label layer will tear with the tear strip 28 when easy-opening of the container 10. Low strength bonding means preferably in the form of a frangible adhesive, is positioned between the reinforcing and tear strip and the lower label layer edge portion 25*a* so that the reinforcing and tear strip 28 will peel and separate from the lower label layer edge portion 25*a* during tearing and removal of the reinforcing and tear strip 28 from the easy-open spiral seam In this embodiment of container 10 illustrated in FIGS. 2–7, it is desirable to remove the entire label layer 25 from the bodywall layer 17 during easy-opening of the container 10 because of the presence of a coupon on the underside of the label or otherwise. For that purpose, the directionally-orienting tear means further includes low strength bonding means 30, preferably in the form of a frangible adhesive, positioned between the remainder of the label layer 25 and the bodywall layer 17 so that the remainder of the label layer 25 will peel and separate from the bodywall layer 17 during removal of the reinforcing and tear strip 28 from the easy-open spiral seam 20 for complete removal of the label layer 25 from the container 10 during easy-opening. This is illustrated in FIGS. 6 and 7.

Figure 2:
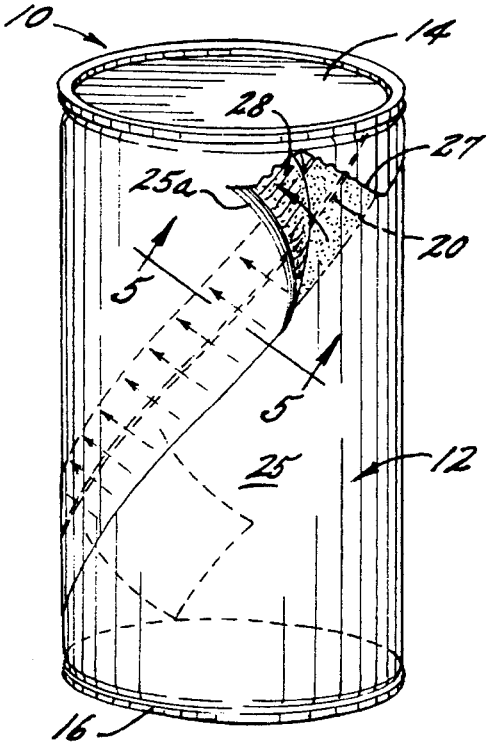
FIG. 2 is a perspective view of an easy-open container provided according to another preferred embodiment of this invention and illustrating the beginning of the easy-opening of the container.
Figure 3:
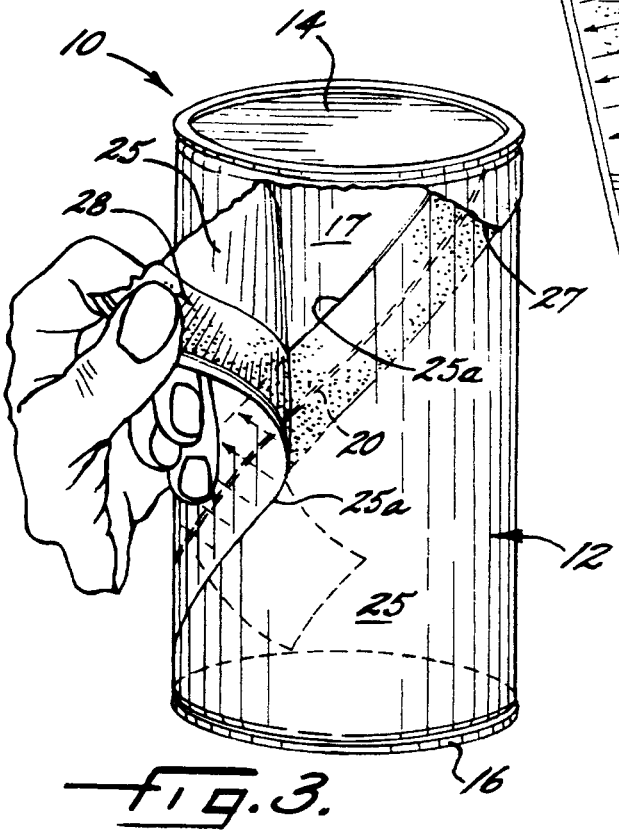
FIG. 3 is a perspective view, like FIG. 2, showing a further progression of the easy-opening of the container of FIG. 2.
Figure 4:
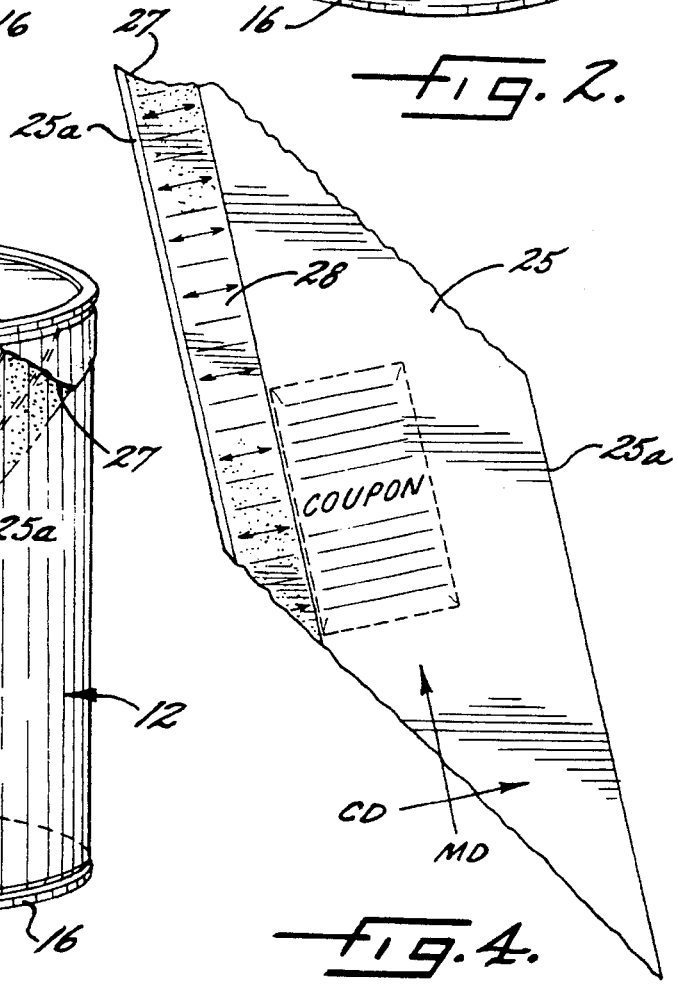
FIG. 4 is a plan view of the label layer of the container of FIGS. 2 and 3 after it has been totally removed from the container.
Figure 5:
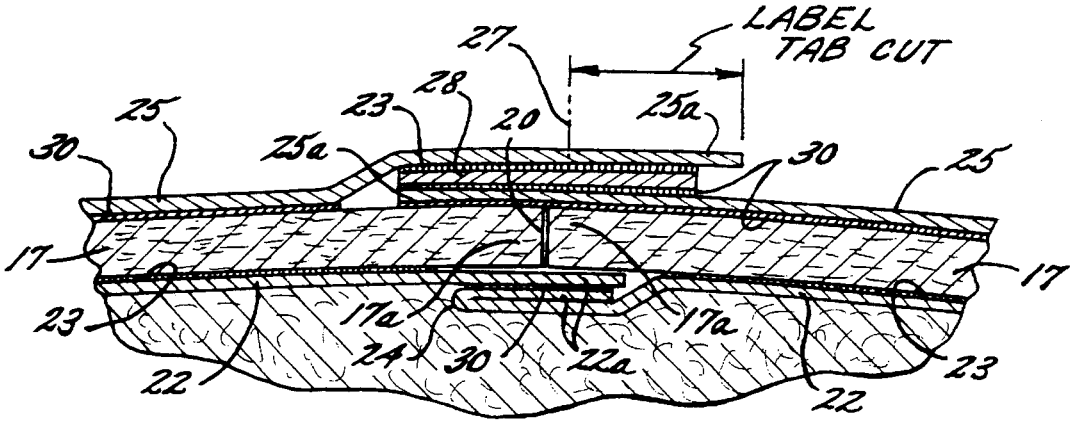
FIG. 5 is a greatly enlarged fragmentary sectional view taken generally along the line 5—5 of FIG. 2 and illustrating the construction of the easy-open seam of the container.

The directionally-orienting tear means further includes means incorporated directly in the reinforcing and tear strip 28 to orient tearing thereof in a transverse or cross-machine direction of such strip, as indicated by the arrows in FIGS. 2–4, so that tearing of the strip 28 will occur in a transverse direction and cause tearing of the label layer 25 also in that direction (as shown in FIG. 2). The tearing of the label layer 25 will continue in that direction to the upper end of the container 10 which has been closed by the closure 14 and will tear along the closure 14 circumferentially of the container 10 as the tear strip 18 is being peeled from the lowermost label layer edge portion 25*a* and downwardly along the spiral seam 20 (as shown in FIG. 3) until the label layer 25 reaches the bottom of the container 10. The tearing of the label layer 25 then continues circumferentially around the bottom of the container 10 along the closure 16 to remove the entire label layer 25 from the container 10 and expose the coupon for removal by the user (as shown in FIG. 4).

The reinforcing and tear strip 28 may be formed from an oriented polymer film material, such as nylon, polypropylene, polyethylene terephthalate, etc. The directionally-oriented tear means incorporated in the reinforcing and tear strip 18 may be formed by orienting the polymer film material during manufacture. This can be accomplished by squeezing the molten resin from an extruder through a linear coat hanger dye into a thin wide sheet that is cast onto a highly polished chill roll, cooled and wound into a roll. By drawing the film faster over a chill roll in one direction versus the other, an orientation is imparted to the film plane. The long molecular structure is weakly cross-linked. This weaker, cross-linking fails easier than the long chain molecules, when force is applied, such as pulling during opening of the container 10. A polymer film material manufactured using the above techniques will tear in the cross-machine or transverse direction significantly easier than in the machine or longitudinal direction. The directionally-oriented tear means incorporated in the reinforcing and tear strip 28 may also be formed mechanically including laser or heating to form scores or other prestressing or by folding or the like to form stress lines.

Referring now to the modified embodiment of container 10 illustrated in FIG. 1, this embodiment includes all of the above described elements and features of the container embodiment of FIGS. 2–7 except that the reinforcing and tear strip 28 is eliminated and is not part of the directionally-orienting tear means. Therefore, like reference characters are given for the same features in this embodiment. The directionally-oriented tear means in this embodiment of container 10 of FIG. 1 includes means incorporated directly in the label layer 25 itself and for orienting the tear thereof in generally a transverse direction of the label layer 25 and in generally a cross-machine direction of the label layer strip, as indicated by the arrows in FIG. 1. The directionally-orienting tear means for this embodiment of container 10 of FIG. 1 could also include desired low strength bonding means, as described above so that the label layer 25 will tear in generally the same direction and will be removed from the container 10 in generally the same manner as described above in connection with the embodiment of container 10 of FIGS. 2–7. For the purposes of this embodiment of FIG. 1, the label layer 25 could be constructed of an oriented polymer film material as described above for the reinforcing and tear strip 28 laminated with other layers or materials, such as poly/poly, poly/kraft, poly/foil/poly, poly/foil/kraft, poly/metalized/poly, poly/metalized/kraft. The directionally-oriented tear means incorporated in the label layer 25 could be formed in the same manner as described above for the reinforcing and tear strip 28.

It would, of course, be within the scope of this invention for the directionally-orienting tear means to include a directionally-oriented tear feature incorporated directly in both a label layer 25 and in a reinforcing and tear strip 28 for an easy-open container 10 and these components could be constructed of the materials described above with the directionally-oriented tear in each as described above.

Referring now to the embodiment of container 10 shown in FIGS. 8–10, like reference characters are given to components which are the same as described above with respect to the embodiments of FIG. 1 and FIGS. 2–7 and only the differences in this embodiment of FIGS. 8–10 will be described. Basically, it is the intent of the construction of the easy-open container 10 of this embodiment of FIGS. 8–10 to remove only that portion of the label layer 25 which bridges the easy-open seam 20 during removal of the reinforcing and tear strip 28, as shown in FIG. 8. The remainder of the label layer 25 would remain attached to the bodywall layer 17.

For that purpose, the upper label layer edge portion 25*a* and the reinforcing and tear strip 28 only are in bridging relation to the spiral seam 20 in the bodywall layer 17 and the directionally-orienting tear means also includes a low strength bonding means, preferably in the form of a frangible adhesive, positioned between the reinforcing and tear strip 20 and the bodywall layer 17 on either side of the spiral seam 20 so that the strip 28 will peel and separate from the bodywall layer 17 and away from the spiral seam 20 during tearing and removal of the tear strip 28, and the upper label layer edge portion 25*a* bonded thereto in the manner described above. The directionally-orienting tear means also includes a high strength bonding means 23 positioned between the remainder of the label layer 25*a* and the bodywall layer 17 so that the remainder of the label layer 25 will remain bonded to the bodywall layer 17 and tear from the reinforcing and tear strip 28 and the upper overlapped label layer edge portion 25*a* bonded thereto during removal thereof from the easy-open spiral seam 20 for exposing the spiral seam 20 during easy-opening of the container 10 (as shown in FIGS. 8 and 10). As shown in these figures, the label layer 25 will tear at the spiral line at which it moves from superimposed position with the reinforcing and tear strip 28 to direct superimposed position with the label layer 17.

The directionally-orienting tear means also includes means incorporated directly in the reinforcing and tear strip 28 for orienting tear thereof, like the embodiment of container 10 illustrated and described with respect to FIGS. 2–7, so that the reinforcing and tear strip and the label layer edge portion 25*a* bonded thereto will tear in a transverse direction across the tear strip 28 to the tear line described above for the remainder of the label layer 25 which is bonded by high strength bonding means 23 to the label layer 17 for removal of only that portion thereof which bridges the spiral seam 20 for easy-opening of spiral seam 20 and the container 10. The tear strip 28 and the directionally-oriented tear incorporated therein may be the same as that described above with respect to the embodiment of container 10 of FIGS. 2–7.

Various adhesives may be employed to provide the permanent adhesive utilized for the high strength bonding means 23. The tear or peel strength of this permanent adhesive will vary depending upon the materials used in the component layers of the container 10. The tear or peel strength must be greater than the tear strength of the liner layer 22 and the label layer 25 so that these layers will tear when the tear strip 28 is torn along the easy-open spiral seam. With current materials used for these component layers, it has been found that a peel strength greater than 2.20 lbs. per square inch is necessary. The permanent adhesive may include polyvinyl alcohol with or without clay mix, blended or reactor resins, special additives, such as manufactured by H. B. Fuller and identified as A1940 having 4000 CPS viscosity, 55% solids and 5.0 pH, K6030 having 3050 CPS viscosity, 55% solids and 5.0 pH, H3935 having 5500 CPS viscosity, 52% solids and 5.0 pH, and by National Starch and identified as 32-1984 having 5400 CPS viscosity, 56% solids and 4.5 pH, and 32-0215 having 4500 CPS viscosity, 55% solids and 4.0 pH.

Various adhesives can be employed as the frangible adhesive forming the low strength bonding means 30. The tear or peel strength of this frangible adhesive will vary depending on the materials used in the component layers of the container 10. The peel strength must be weak or less than the tear strength of the liner layer 22 and the label layer 25 so that the layers will peel rather than tear. With current material used, it has been found that a peel strength of 0.42 to 1.99 pounds per square inch is preferred. The frangible adhesive may include a high initial tack dextrine based adhesive commercially available from National Starch and Chemical Corporation, Grand Prairie, Tex. as "71-5626B". This is a high solids (about 64%), high viscosity (about 2100 cps) acid modified (about 2.5 Ph) dextrine adhesive. Other frangible adhesives which can be successfully used include heavily filled, resinous, aqueous emulsion type adhesives such as, for example polyvinylacetate dispersed in water together with a tackifying alcohol and an inert filler such as clay, silicon dioxide calcium carbonate, talc and the like. The inert filler can insure that a weak discrete layer of adhesive remains between the superimposed components of the container to thereby provide for the fracture or breaking of the adhesive. In the alternative, a release coating, such as a microcrystalline wax, silicone or the like can be provided on the inner surface on either or both of the superimposed components of the container so that the adhesive layer is readily released upon drying.

It is important that the frangible adhesive used for the low strength bonding means 30 have a high initial tack or adhesive so that the overlapped components between which it is positioned are held together during, and immediately following, manufacture of the container 10. It is also important that this frangible adhesive be capable of readily allowing peeling or separating of the superimposed components between which it is positioned upon easy opening of the container 10 by tearing the tear strip 28 along the easy-open seam Referring now to FIG. 11, a preferred method and apparatus is diagrammatically illustrated and which is suitable for producing the easy-open container 10 of this invention and particularly the embodiments of FIGS. 2–7 and 8–10.

As may be seen in FIG. 11, a flexible barrier liner layer 22 in strip form is provided from any suitable source of supply and is fed at a desired angle to a mandrel 52 of a suitable tube spiral winding machine for being spirally-wound on the mandrel 52 to form overlapping liner layer edge portions 22*a* in a manner well understood by those with ordinary skill in the art. While the liner layer 22 is being fed to the mandrel 52, one of the longitudinal edge portions thereof is folded over on itself by an edge folder 53 to form a pleat 24. Also, while the liner layer 22 is being fed to the mandrel 52, a heater device 54 heats the other longitudinal edge portion 22*a* of the liner layer 22 so that when these liner layer edge portions 22*a* are overlapped with each other, a low strength bonding means 30 in the form of a heat seal will be positioned between such overlapped liner layer edge portions 22*a*.

A paperboard bodywall layer 17 in strip form is provided from any suitable source of supply and is fed at a desired angle to the mandrel 52 for being spirally-wound onto the spirally-wound liner layer on the mandrel 52 while positioning the longitudinal edges of the bodywall layer 17 in butt joint edge relationship to form a tube having a spiral seam extending the length thereof in a manner well understood by those with ordinary skill in the art. While the bodywall layer 17 is being fed to the mandrel 52, a permanent adhesive 23 is applied by a suitable adhesive applicator device 55 onto the top surface of the bodywall layer 17 to form a high strength bond between the bodywall layer 17 and the liner layer 22 when the bodywall layer 17 is spirally-wound onto the liner layer 22 on the mandrel 52.

A label layer 25 in strip form is provided from a suitable supply source and is fed at a desired angle to the mandrel 52 for spirally-winding thereof onto the outer surface of the tube formed by the spirally-wound bodywall layer 17 and liner layer 22 as such tube is moving forward on the mandrel 52. While the label layer 25 is being fed to the mandrel 52, a reinforcing and tear strip 28 of narrower width than the label layer strip 25 and having a means incorporated therein for directionally-orienting tear in the transverse direction thereof is provided from a suitable supply source and is positioned in superimposed position under one outer longitudinal edge portion 25*a* of the label layer strip 25. Prior to positioning of the reinforcing and tear strip 28 under the one label layer longitudinal edge portion 25*a*, a permanent adhesive is applied by a suitable applicator device 56 along the upper surface of the strip 28 so that a high strength bond is formed between the strip 28 and the one outer label layer edge portion 25*a* when the strip 28 is superimposed thereunder.

While the superimposed reinforcing and tear strip 28 and label layer strip 25 are being fed to the mandrel 52, a frangible adhesive for the embodiment of container be of FIGS. 2–7 or a permanent adhesive for the embodiment of container 10 of FIGS. 8–10 is applied to the remainder of the bottom surface of the label layer strip 25 which is not covered by the reinforcing and tear strip 28 by a suitable adhesive applicator device 58 to form a low strength bond or a high strength bond between the label layer 25 and the bodywall layer 17 when the label layer 25 is spirally-wound onto the bodywall layer 17. Also, while the label layer strip 25 and the reinforcing and tear strip 28 are being fed to the mandrel 52, a frangible adhesive is applied by a suitable adhesive applicator device 59 to the bottom surface of the reinforcing and tear strip 28 for forming a low strength bond between the tear strip 28 and the other label layer longitudinal edge portion 25*a* when the label layer edge portions 25*a* are overlapped with each other during spiral-winding thereof. While the label layer strip 25 and reinforcing and tear strip 28 are being fed to the mandrel 52, a tab cut is formed by a suitable cutting mechanism 60 through the one outer label layer edge portion 25*a* and the reinforcing and tear strip 28.

The thus spirally-wound continuous tube having bodywall layer 17, liner layer 22 and label layer 25 are moved forwardly on the mandrel 52 to a cutting station where suitable cutting devices 65 cut the continuous tube into individual links for containers be.

Thus, it may be seen, that this invention has provided an easy-open container for packaging various products, particularly products under pressure, and which provides means for directionally-orienting tearing of the label layer 25 to remove at least that portion of the label layer 25 in bridging relation to the easy-open spiral seam 20 of the bodywall layer 17 of the container be to allow opening of the container 10 along such spiral seam 20. A method has also been provided which may be utilized on conventional spiral-winding equipment without substantial modifications or new devices therein.

The invention has been described in considerable detail with reference to its preferred embodiments. However, variations and modifications can be made within the spirit and scope of the invention as described in the foregoing specification and as defined in the following claims.

What is claimed is:

1. A method of manufacturing an easy-open container having directionally-orienting tear comprising the steps of:

applying a flexible barrier liner layer in strip form, feeding the liner layer to a mandrel, and spirally-winding the liner layer on the mandrel to form overlapping liner layer edge portions;

applying a paperboard bodywall layer in strip form, feeding the bodywall layer to the mandrel, and spirally-winding the bodywall layer onto the spirally-wound liner layer on the mandrel while positioning the longitudinal edges of the bodywall layer in butt joint edge relationship to form a tube having a spiral seam extending the length thereof;

applying a flexible label layer in strip form and a reinforcing and tear strip of narrower width than the label layer strip and having a directionally-oriented tear incorporated therein in the transverse direction thereof, feeding such label layer and reinforcing and tear strip to the mandrel while applying a high strength bonding means to an upper surface of said reinforcing and tear strip and positioning the reinforcing and tear strip in superimposed position under one outer longitudinal edge portion of the label layer strip with the high strength bonding means therebetween and applying a low strength bonding means to a lower surface of said reinforcing and tear strip, and spirally-winding the superimposed label layer strip and reinforcing and tear strip onto the continuous tube on the mandrel with the longitudinal edges of the label layer strip in overlapped relation and positioning the reinforcing and tear strip and low strength bonding means in bridging relationship to the spiral seam in the spirally-wound bodywall layer; and cutting the thus wound tubes into container lengths.

2. A method of manufacturing an easy-open container, as set forth in claim 1, further including forming a tab cut through the one outer label layer longitudinal edge portion and the reinforcing and tear strip during feeding of the label layer and reinforcing and tear strip to the mandrel.

3. A method of manufacturing an easy-open container, as set forth in claim 2, or 2, further including applying a low strength bonding means to the lower surface of the label layer not covered by the reinforcing and tear strip during feeding of the label layer and reinforcing and tear strip and the mandrel.

4. A method of manufacturing an easy-open container, as set forth in claim 3, in which said steps of applying a low strength bonding means comprises applying a frangible adhesive, and in which said step of applying a high strength bonding means comprises applying a permanent adhesive.

5. A method of manufacturing an easy-open container, as set forth in claim 2, or 2, further including applying a high strength bonding means to the lower of the label layer not covered by the reinforcing and tear strip during feeding of the label layer and reinforcing and tear strip to the mandrel.

6. A method of manufacturing an easy-open container, as set forth in claim 5, in which said steps of applying a high strength bonding means comprises applying a permanent adhesive, and in which said step of applying a low strength bonding means comprises applying a frangible adhesive.

* * * * *

UNITED STATES PATENT AND TRADEMARK OFFICE

CERTIFICATE OF CORRECTION

PATENT NO. : 5,547,451

DATED : August 20, 1996

INVENTOR(S) : Drummond et al

It is certified that error appears in the above-identified patent and that said Letters Patent is hereby corrected as shown below:

Column 4, lines 21, 24, 26, 28, 30 and 35; column 5, lines 7, 23, 29, 31 and 34; column 9, lines 35 and 61; column 10, line 1, "be" should be -- 10 --.

Column 4, line 39, after "container" insert -- 10. --.

Column 4, line 64, after "liner layer" insert -- 22 --.

Column 5, line 43, after "label layer" insert -- 25 --.

Column 5, line 45, after "means" insert -- 30. --.

Column 5, line 46, after "strip" insert -- 28 --.

Column 5, line 51, after "seam" insert -- 20. --.

Column 5, line 56, after "label" insert -- 25 --.

Column 6, lines 9 and 22, "18" should be -- 28 --.

Column 7, line 25, "20" should be -- 28 --.

Column 8, line 47, after "seam" insert -- 20. --.

Column 8, line 59, after "portions" insert -- 22a --.

UNITED STATES PATENT AND TRADEMARK OFFICE

CERTIFICATE OF CORRECTION

PATENT NO. : 5,547,451

DATED : August 20, 1996

INVENTOR(S) : Drummond et al

It is certified that error appears in the above-identified patent and that said Letters Patent is hereby corrected as shown below:

Column 9, line 4, after "layer" insert -- 22 --.

Column 9, line 7, after "seam" insert -- 20 --.

Column 10, lines 15, 19 and 26, "applying" should be -- supplying --.

Column 10, lines 55 and 67, "claim 2" should be -- claim 1 --.

Signed and Sealed this

Seventeenth Day of December, 1996

*Attest:*

Bruce Lehman

BRUCE LEHMAN

*Attesting Officer*

*Commissioner of Patents and Trademarks*